US008326773B1

(12) United States Patent
Bellamy et al.

(10) Patent No.: US 8,326,773 B1
(45) Date of Patent: Dec. 4, 2012

(54) SYSTEMS AND METHODS FOR COST-PLUS PRICING

(75) Inventors: Josh Bellamy, Dunlop, IL (US); Steve Benson, Woodbury, MN (US)

(73) Assignee: Health Strategy, LLC, Dunlap, IL (US)

( * ) Notice: Subject to any disclaimer, the term of this patent is extended or adjusted under 35 U.S.C. 154(b) by 349 days.

(21) Appl. No.: 12/550,974

(22) Filed: Aug. 31, 2009

Related U.S. Application Data

(60) Provisional application No. 61/093,039, filed on Aug. 29, 2008.

(51) Int. Cl.
*G06Q 99/00* (2006.01)

(52) U.S. Cl. ..... 705/400; 705/1.1; 705/2

(58) Field of Classification Search ..... 705/2, 400
See application file for complete search history.

(56) References Cited

U.S. PATENT DOCUMENTS

| | | | | |
|---|---|---|---|---|
| 2004/0117323 | A1* | 6/2004 | Mindala | 705/400 |
| 2005/0065821 | A1* | 3/2005 | Kalies, Jr. | 705/2 |
| 2009/0313039 | A1* | 12/2009 | Cedergreen | 705/2 |
| 2010/0057640 | A1* | 3/2010 | Cannata | 705/400 |

OTHER PUBLICATIONS

Golden, Joshua, "Assessing the First DataBank Settlement: Dramatic Shake-Up or Status Quo?", Fourth Quarter 2008, Benefits Quarterly, pp. 3, 12-15; 24, 4; ABI/INFORM Global.*

Bellamy, Josh and Benson, Steve; "Parsing Complexity: Potential Pharmacy Cost-Minimization Strategies for Plan Sponsors", Aug. 18, 2008, lyceumassociates.com, 4 pages.*

"Walgreens Joins Forces With Caterpillar to Lower Prescription Drug Costs", Aug. 26, 2009, The Institute for HealthCare Consumerism; 2 pages.*

* cited by examiner

*Primary Examiner* — John Hayes
*Assistant Examiner* — Freda A Nelson
(74) *Attorney, Agent, or Firm* — Lewis, Rice & Fingersh, L.C.

(57) ABSTRACT

Systems and methods, specifically computer implemented systems and methods for determining cost-plus pricing for pharmaceuticals. Specifically, systems and methods which can provide for transparent pricing which helps to provide a reasonable profit for a pharmacy while also generally providing competitive or reduced cost prescriptions to individual patients.

13 Claims, 12 Drawing Sheets

SYSTEMS AND METHODS FOR COST-PLUS PRICING

CROSS REFERENCE TO RELATED APPLICATION(S)

This application claims benefit of U.S. Provisional Patent Application Ser. No. 61/093,039 filed Aug. 29, 2008, the entire disclosure of which is herein incorporated by reference.

BACKGROUND

1. Field of the Invention

The present invention generally relates to systems and methods for determining pricing of prescription medications and similar goods and for implementing transparent pricing models for prescription medications. Specifically, it relates to computer systems for performing such methods.

2. Description of the Related Art

Healthcare spending has been estimated as being more than 15% of the GDP of the United States and one of the largest segments of the economy on which money is spent totaling in at over two trillion dollars a year. Even with this much being spent, however, there are questions as to how effective the spending is.

Recent political concerns exist that not enough healthcare is available and what is available is too expensive for what it provides. Further, there is a running popular sentiment that many in the healthcare industry get rich catering to those who are desperate for their products while keeping the cures away from those who won't pay what are sometimes seen as exorbitant prices. There are proposals to try to improve the access to care for a variety of individuals at lower costs but, while society may generally support granting these people access to care, a perpetual problem is how to pay for it and how to know that money is being spent wisely.

One of the principal targets of concern is prescription medication pricing. Currently, the cost of prescription drugs is of significant concern for a number of businesses and government entities that supply health insurance and health care plans, as well as the population as a whole. There are bus trips for seniors to go to Canada to purchase prescription medications where they are less expensive than in the United States as it is seen that many, particularly brand name, medications are simply to expensive to be affordable on a fixed income. Even for those that can afford the drugs, there is concern about determining if medications are actually provided by a pharmacy at a reasonable cost since there is very little possibility of an end consumer comparison shopping their prescription.

Recently, a number of pharmacies have made headlines by offering fixed price, relatively low cost, prescription medications and refills for many commonly prescribed medications. These acts are being copied by other pharmacies and have definitely provided a lower cost alternative for these specific medications. At the same time, in some instances, these programs can actually result in a net loss for the pharmacy. They are providing pharmaceuticals at a cost which cannot cover their expenses and expect to make up the difference from other sales that may occur at the same time to the same customer, or simply from improved customer goodwill. In some cases, the pharmacies may not even realize they are losing money on the transactions as they cannot effectively analyze their costs on those prescription medications provided under the program. In still other cases, these prices may provide for large profit margins.

One problem with the fixed price arrangement is that not all prescriptions for the same medication prescribe the same amount. For example, in one person's prescription, the one month usage may comprise 30 pills (one per day) while in another person's prescription, the usage may be 60 pills (two per day). If fixed pricing is setup based on the smaller prescription, but the large is more common, the pharmacy may be dispensing at a net loss. Similarly, if the pharmacy bases the pricing on the larger prescription, they may not be cost competitive on the smaller one. Similarly, an initial prescription for one person may be 14 doses with a refill for another 14 doses, while for another its 28 doses without an available refill resulting in two "fills" for the first but only one for the second. Because of problems such as this, many fixed cost prescription services limit the available medications to specific drugs where dosing may be more standardized and costs may be more fixed.

Companies that sell prescription fulfillment services and the related medications often have to distinguish themselves on price factors (or improved service or hours) only, as the goods they sell are essentially identical to those sold by others. Further, simply reducing or increasing a price may not always result in a maximized profit for the business as lowering the price too far can result in insufficient profit from the sale and raising it too much can result in potential customers going elsewhere. For this reason, the ability to determine pricing for prescription medications which allows for the business to maximize sales under a given business model can be important. Further, even if a point of maximum return cannot be obtained, the ability to detect trends which can direct a business to a pricing model which improves profits is clearly desirable.

Such pricing, however, can be difficult because pharmaceutical pricing is often not transparent as contemplated above. Instead, the specific costs associated with any particular medication can be difficult to determine due to variability on the size and nature of the transaction. Thus, it can be very difficult to determine if a chosen price is desirable.

SUMMARY

The following is a summary of the invention in order to provide a basic understanding of some of the aspects of the invention. This summary is not intended to identify key or critical elements of the invention or to delineate the scope of the invention. The sole purpose of this section is to present some concepts of the invention in a simplified form as a prelude to the more detailed description that is presented later.

For the above, and other reasons known to those of ordinary skill in the art, described herein are systems and methods for determining a cost-plus price for products, specifically pharmacy products such as prescription medications and prescription only medical devices and supplies.

There is described herein, among other things, a method of determining cost-plus pricing on a computer, the method comprising: determining a net cost per unit of a prescription medication; determining the average units in each prescription for said prescription medication; calculating a baseline cost per prescription from said cost per unit and average units in a prescription; modifying the cost per prescription to provide for a marked up price per prescription; and utilizing said cost per prescription and the average units in each prescription to determine a marked up cost per unit.

In an embodimentn of the method the step of modifying comprises multiplying said cost per prescription by a predetermined weighting factor which may be different for a generic medication than a branded medication. In an embodiment, the weighting factor is greater for a generic medication than a branded medication.

In another embodiment of the method, the step of modifying further includes adding a fixed dollar value to the cost per prescription which may be different for a generic medication than a branded medication. In an embodiment, the fixed dollar value is greater for a generic medication than a branded medication. The fixed dollar value may also or alternatively include multiple tiers based on the cost per prescription which may be different for branded medications and generic medications.

In another embodiment of the method, modifying further includes multiplying the cost per prescription by a final markup after adding said fixed dollar value. The final markup may be different for a generic medication than a branded medication and may be greater for a generic medication than a branded medication.

There is also provided a computer, computer network, system or means for implementing any of the above methods.

There is also provided a computer readable medium, such as computer memory, including instructions for implementing any of the above methods on a computer system.

There is also described herein a computer readable medium comprising: computer readable instructions for determining a net cost per unit of a prescription medication; computer readable instructions for determining the average units in each prescription for said prescription medication; computer readable instructions for calculating a baseline cost per prescription from said cost per unit and average units in a prescription; computer readable instructions for modifying the cost per prescription to provide for a marked up price per prescription; and computer readable instructions for utilizing said cost per prescription and the average units in each prescription to determine a marked up cost per unit.

There is also described herein a computer system comprising: means for determining a net cost per unit of a prescription medication; means for determining the average units in each prescription for said prescription medication; means for calculating a baseline cost per prescription from said cost per unit and average units in a prescription; means for modifying the cost per prescription to provide for a marked up price per prescription; and means for utilizing said cost per prescription and the average units in each prescription to determine a marked up cost per unit.

DESCRIPTION OF THE PREFERRED EMBODIMENT(S)

Figure 1:
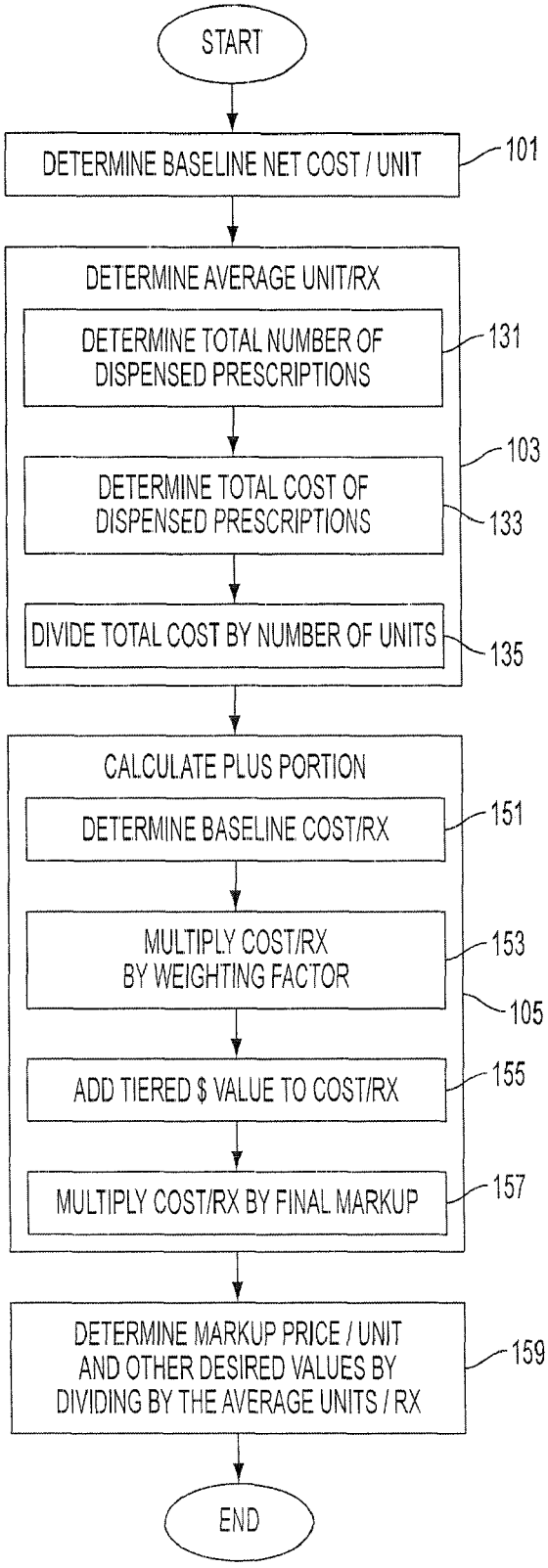
FIG. 1 Provides a flowchart showing an embodiment of how to determine a cost-plus price.

Generally there will be discussed herein a method for cost-plus pricing. This particular embodiment utilizes the methodology for the sale of prescription medications (and related items such as prescription devices or supplies) in a generally retail environment. That is, the medications are intended to be used by the person purchasing them who is the end consumer. The systems and methods would be used by the pharmacy (or other service provider) supplying the medications. In alternative embodiments, the methodology can be applicable in other areas as would be understood by those of ordinary skill in the art and can also be used in different areas of a supply chain if a cost-plus pricing methodology is appropriate.

The methods discussed herein can be used to provide for increased transparency in pricing for businesses which may wish to utilize the pharmacy (or pharmacy chain) as a prescription supplier for their employees. The systems and methods can provide for clear indications of the level of profit, as well as cost, to make it easier for an employer to evaluate the fairness of the pricing of the pharmacy. It can also help them to determine that their employees actually will save money (and how much) utilizing a pharmacy which prices based on the determinations of the systems and methods. This can help to insure that the pharmacy makes a reasonable profit on its pharmacy transactions, while at the same time helping to insure that patients and related healthcare "payors" purchasing their prescriptions are provided with competitive prices which will often be below those typically charged for the same or similar products.

Generally, the systems discussed herein will comprise computerized analytical systems comprising one or more processors designed to work together to produce a coherent computing system. The processor(s) will generally be in the form of a general purpose computer but may alternatively be a computer or other machine or device specifically constructed to carry out the operations discussed herein. The system may be contained on a single machine or distributed across a network of machines, whether physical or virtual.

The computer system will generally have access to computer readable memory of any form (such as, but not limited to a hard disk, disk array, floppy disk, or non-volatile memory device) which may be local or remote and which includes instructions for instructing the computer system to carry out the methods and analysis discussed herein by providing computerized modeling and analysis based upon those instructions. The instructions may comprise a single "software package" or multiple different pieces of software which perform different aspects of the invention. In an embodiment, the software can be built within existing software packages such as, but not limited to, Microsoft Excel™ or Access™ to utilize components of those software packages in its operation. Alternatively, the computer may include hardwired circuits or other hardware which is built to allow the machine to act in accordance with the methods discussed herein.

The processor(s) will generally provide output to a user (such as via a display or printer) which that user can either use as is (that is the computer can provide a suggested price or other final determination), or the computer can provide more raw data upon which a human user can provide further computation or analysis in order to provide for forecasting or modeling (for example it could provide a cost indicator allowing a human to take the step of adding on an additional profit margin). The system will also generally include computer accessible databases of stored information which can be accessed by the processor(s) to carry out the methods. The databases can be created and utilized for each pharmacy individually, or may be utilized across a number of pharmacies allowing for generally available pricing to be used consistently through multiple applications of the system.

In order to show the methodology of how to reach a cost-plus price determination, it is best to Examine the flowchart of FIG. 1. In the embodiment of FIG. 1 there are provided a series of steps any of which could be carried out by the processor(s), human user(s), or both. It should be recognized that the order to the steps provided in this embodiment is merely exemplary, and in other embodiments, steps may be taken in alternative orders.

The discussion below will contemplate "units" of a prescription drug, but will also discuss "prescriptions." Generally a "unit" will be the individual unit in which the drug is provided. This may be an individual tablet, a sealed package, a liquid measure such as a milliliter, or other "unit" of sale which a prescription will generally include as a smallest possible division. Similarly, a "prescription" will comprise one or more units which is dispensed to the patient at any single time. The prescription could then be refilled at a later time, generally for a similar number of units.

To show the definition by example, a individual unit of a medication which is provided to the pharmacy as bulk tablets could be a single tablet. A prescription of this medication may then provide for 30, 60, or another number of tablets geared to a particular dosage regimen. Similarly, if the medication comprises a series of different tablets which comprise a month-long regimen to be taken in particular order and pattern and provided on a single card or package, the unit could comprise a single such package and the prescription may comprise one or more such packages. Similarly, a nasal spray dispenser which comes provided with a predetermined number of fixed size prays could also be provided as a single unit. A liquid medication may comprise a prescription of 300 ml (units) of liquid.

In the embodiment of FIG. 1, the method begins in step (101) where data is input into the machine representative of the baseline cost/unit to the pharmacy for each prescription drug product. This cost would generally represent what the pharmacy pays the wholesaler or manufacturer for each of the drugs. All drugs would generally be identified by one or more of the following: Generic Product Indicator (GPI), National Drug Code (NDC), or GCN to make sure they are correctly and uniquely identified within the system. All drugs would also preferably be labeled with a Generic Indicator. Typical labels include, but are not limited to: G—Generic, B—Branded or O—Other. The advantage of including this indicator is that it can provide for a quick indication of the availability of alternative suppliers or products which may be pharmacologically interchangeable. In this way, the system can also determine which medication (among those that are pharmacologically identical) provides the best value.

The net cost per unit will generally not be entered directly, as it will often be unknown but instead can be calculated based on information known to the pharmacy. This may be particularly valuable as the unit pricing may not be immediately determinable. For example, the pharmacy may have a per unit price they pay, or that price may vary based on how many units are purchased at a time. Similarly, a vendor may provide certain discounts on the purchase of a particular measure above a single unit (e.g. there may be a discount provided on each 500 tablet package purchased). Thus, as discussed more fully below, the cost/unit may be calculated taking into account all these factors. Still further, as all drugs the pharmacy will dispense can be taken into account simultaneously, fixed costs (such as labor and facilities) can be taken into account across multiple drugs to provide for a more accurate determination of the pharmacy's actual cost to provide the drugs.

In step (103) the average units per each prescription dispensed at the pharmacy (or across another source) is determined. This value should generally be based on the entire pharmacy's business and may be determined in the following fashion. In step (131), the total number of prescriptions dispensed for each drug is determined, in step (133) the total number of units dispensed for each prescription is determined and in step (135) the value of step (133) is divided by the value of step (131).

In step (105), the "plus portion" and new price/unit for the drugs products is determined. In an embodiment, this determination can be made in the following fashion: In step (151) the average baseline cost to the pharmacy for each prescription is determined. This may be determined in any manner understood by one of ordinary skill such as, but not limited to, by multiplying baseline cost/unit by the average units/prescription. This provides for a general indicator of the average cost per prescription to the pharmacy.

In step (153), depending on the cost per prescription (price/prescription) determined in step (151), the cost is then multiplied by a preselected weighting factor. In an embodiment of the invention, the factors are chosen as follows. Generally, generics will have a greater weighting factor than brand names. Thus, for a generic, if price/prescription is <$25, then multiply by 1.5, if price/prescription is between $25 and $50, then multiply by 1.4, if price/prescription is between $50 and $75, then multiply by 1.3, if Price/Prescription is >$75, then multiply by 1.2. After the multiplication is performed, a new price per prescription has been determined.

Having the multiplier decrease as the cost of the prescription increases can provide for a two-fold benefit. In the first instance, it is often not significantly more difficult to fulfill a less expensive prescription than a more expensive one and such a weighting takes this into account. Secondly, it allows the pharmacy to help control costs on the most expensive drugs, without necessarily cutting into their profit. Specifically, a smaller multiplier on a bigger underlying number will often still result in a similar net dollar gain.

Due to the difference in price between brand name and generic products the following factors may be used for brand names in an embodiment which are less than those used for generics. If price/prescription is <$50, then multiply by 1.2. If price/prescription is between $50 and $100, then multiply by 1.15. If price/prescription is between $100 and $200, then multiply by 1.1. If price/prescription is >$200, then multiply by 1.05. As should be very apparent, in the case of expensive brand name medications, the new prescription price is closer to the original price than it is for generics or even less expensive branded medications.

In step (155) a fixed dollar value is added to all new prescription prices based on the new prescription price determined in step (153) to provide a marked-up price. In an embodiment of the invention the fixed dollar value is provided in tiers. Again, this can reduce the relative markup of more expensive medications to help control total price. The tiers may be selected as follows: If the new price/prescription is ≦$50, then add $7 while if the new price/prescription is >$50, then add $6.

This calculation may also take into account whether the drug is a branded or generic product. In an embodiment the same tiered dollar values as for generics is used for brand names, but this is by no means required. In an alternative embodiment, different amounts are used for branded medications compared to generics. This may result in a change in the tiers, or may result in a change in the amount using the same tiers, or a combination of both. Thus, if new price/prescription for a branded product is <$150, then one may add $7, while if new price/prescription is >$150, then one may add $6.

In step (157), the marked up price is then multiplied by a final mark-up value which, in an embodiment, comprises multiplying all new generic prescription prices by 1.1. This results in a final prescription price being determined. Again, to take into account the common difference in prices between branded and generic medications, in an embodiment one would multiply all new branded prescription prices by 1.05 instead. This produces the final prescription price.

It should be noted that the resultant pattern comprises three steps of additions. The first is a fixed ratio multiplication, the second is a fixed value addition, and the third is another fixed ratio multiplication. By placing the steps of calculation in this order, there is produced a resultant price which will provide for a generally solid profit margin, while at the same time allowing for resultant total prices to clump together a little more. Thus, this provides for a generally acceptable pricing methodology.

While the above steps provide for a general indication of the price per prescription which may be charged by the pharmacy, additional calculations may be made. In step (159) the final prescription price is divided by the average units/Prescription which provides a "cost-plus" price/unit for a prescription of that prescription item. Similarly, this per unit amount may be multiplied by the total units sold in any time period to obtain a net revenue calculation. This price per unit can then be used in the fulfillment of a prescription to provide for a much more defined cost per prescription.

The "plus portion" (effectively the markup by the pharmacy) and new price/unit for branded and generic products can thus be determined by the machine. From this, the suggested price per prescription can also be determined either by using this value directly, or by treating this as an input and adding an additional profit above it.

As indicated above, the process is generally the same for both generic and branded medications. However, since brand name products are typically more expensive, the multiplication factors and fixed additions for brand name products are usually smaller than those for generics (in the same way they are often smaller for more expensive generics than for less expensive ones).

In effect, because brand name products are more expensive in general, the pharmacy will take a lower percentage markup on them to keep the ultimate price paid by the consumer lower. However, because the branded products have higher starting values, the multiplication factors and the like often end up with larger increases from a pure dollar calculation. Thus, the pharmacy will generally end up making a slightly reduced percentage per sale of the brand name than they will make on the sale of a generic, but may end up with a similar per prescription (or per unit) raw dollar gain.

As should be apparent, the numbers and multipliers selected above merely provide for one embodiment of the invention. These numbers may be modified to meet desired profitability necessary for the pharmacy to maintain operation at a desired profit level or to meet specific targets or benchmarks. These numbers may therefore be selected based on the desired business goals of the party looking to determine the cost-plus value.

It should be recognized that the method described above will generally be implemented in a computer system and instructions for executing the steps of the methods may be stored on a computer readable medium such as a magnetic or similar memory device and the computer can also provide for screens (displays) to provide both places to conveniently enter information and provide for output of information back to a user.

As should be apparent, in a pharmacy carrying many different drugs and products, the steps of FIG. 1 would generally need to be repeated for each product that the pharmacy provided. Thus, the running of the method on a computer system can allow for rapid calculation for multiple drugs, and can provide for quick and easy updating should costs or availability of drugs change.

Further, the system may be performed on stand alone computer systems or may be provided across a network (such as, but not limited to, the Internet) utilizing a client-server architecture where certain actions may be performed on certain machines depending on implementation. Generally, the system may also be provided by a service provider who provides access to the computer system for a pharmacy (or payor business) to determine the most effective pricing model for itself. In this embodiment, a vendor may provide the computer system output to the pharmacy after running programs on their own from data provided by the pharmacy.

Figure 2:
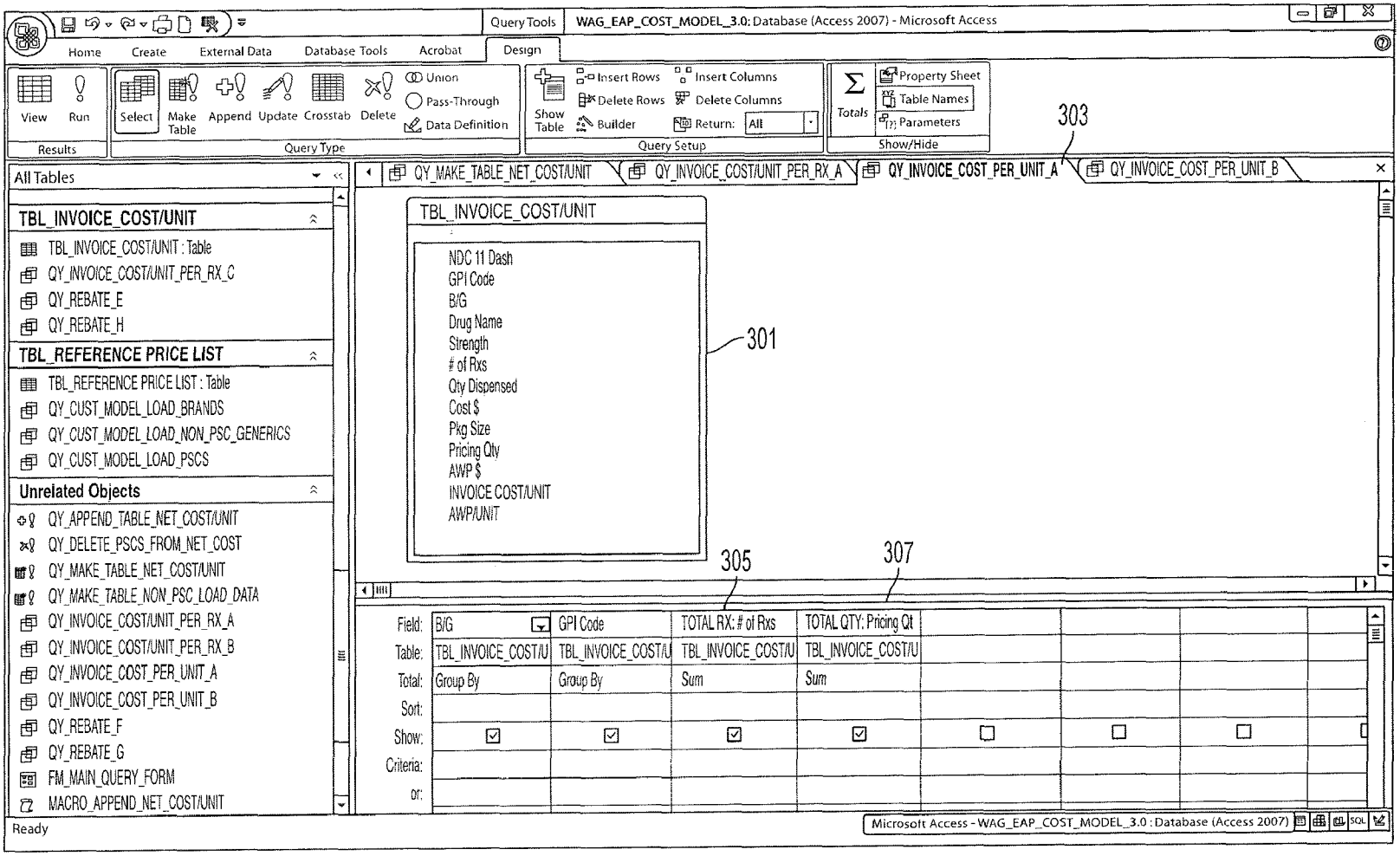
FIG. 2 Provides a screenshot of a place for entering information to calculate a net price/unit at the pharmacy.

Regardless of the particular computer system layout, FIGS. 2-12 provide for screenshots showing operation of an embodiment of a computer program designed to carry out the methods of the present invention. In FIGS. 2-5 the initial net cost per unit to the pharmacy is determined. As should be apparent to one of ordinary skill, the determination of cost can involve many ultimate factors of cost which must be taken into account. In FIGS. 2-5 the basic information is entered pursuant to step (101). Specifically, the individual drugs are identified and entered in preparation for calculations to be performed. This information may be provided by direct entry by a human user, or by automated reading of pharmacy records. As can be seen in FIG. 2 there are places to enter invoice costs per unit (301) as well as labeling the type of drug as generic or branded (305) and GPI coder (307). These entry points are all included as one type of entry categorized under tab (303).

Figure 3:
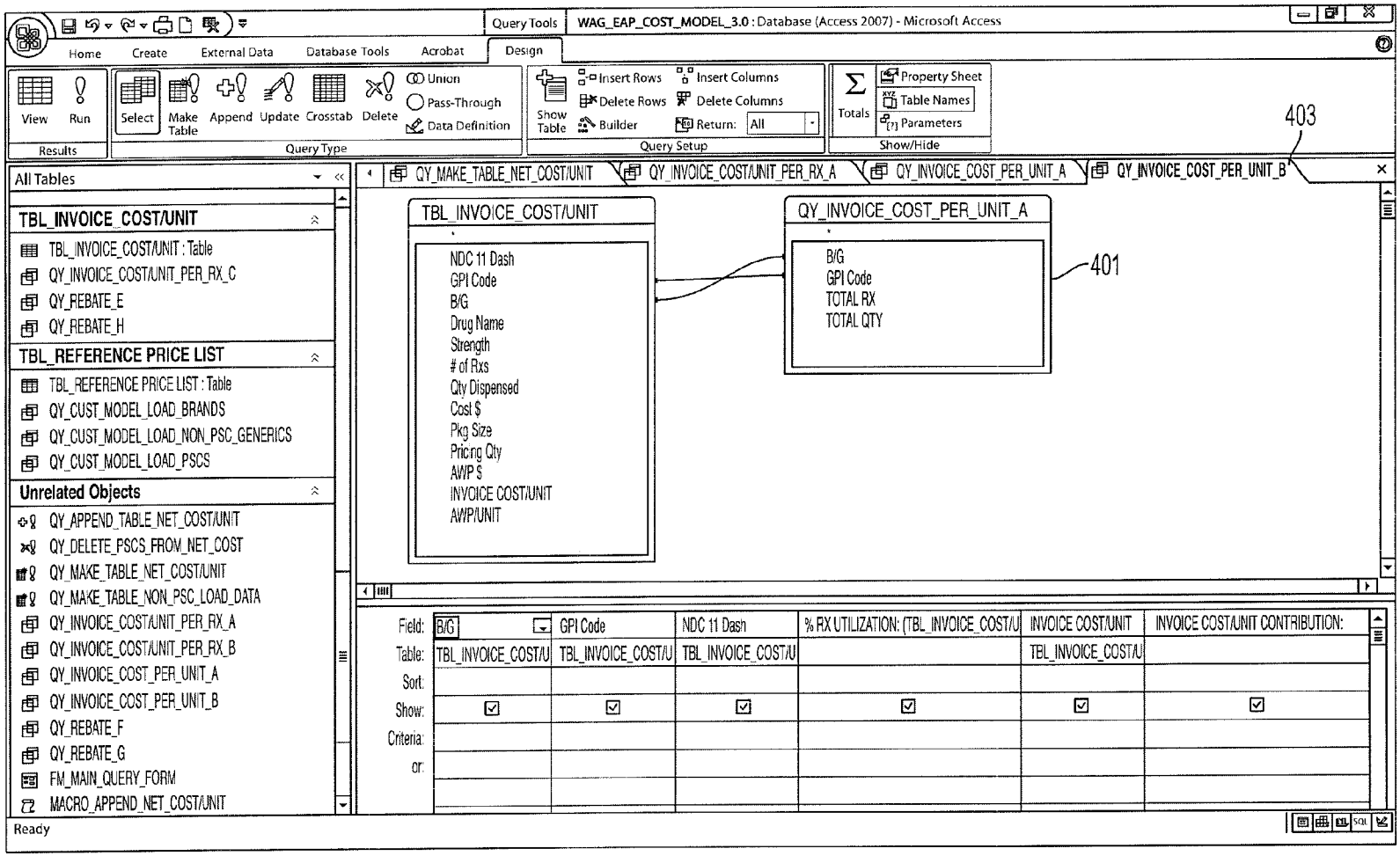
FIG. 3 Provides a screenshot of a place for entering additional information to calculate a net price/unit at the pharmacy.
Figure 4:
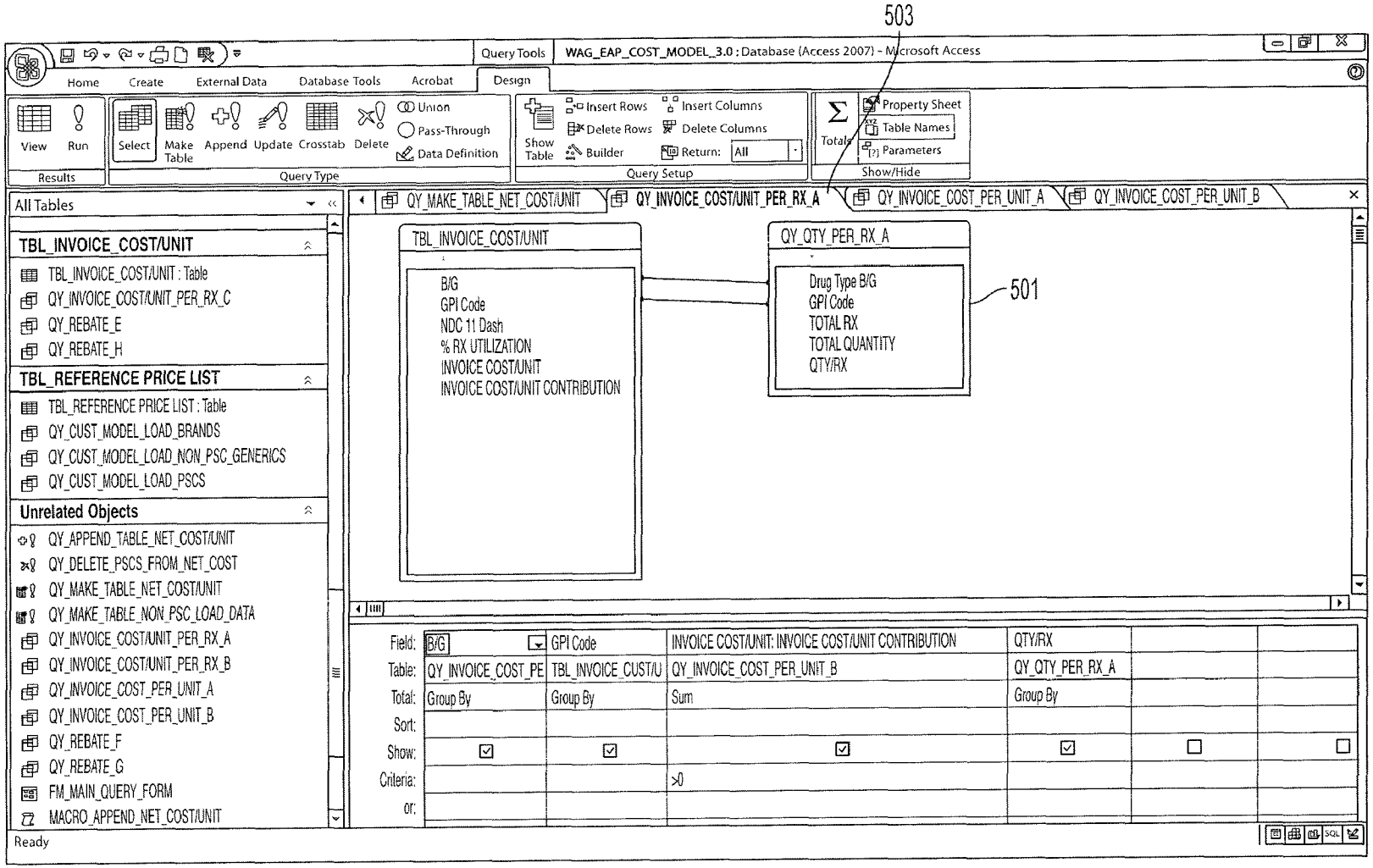
FIG. 4 Provides a screenshot of a place for entering additional information to calculate a net price/unit at the pharmacy.

In FIG. 3 additional information identifying the prescription and sales information may be entered on a per unit basis indicating information which may be provided (401). This information is again categorized under a different tab (403). This is continued in FIG. 4 where additional information related to cost (such as any discounts or similar vendor identifying information may be provided). In FIG. 4 information more directly related to per prescription costs (503) may be entered in section (501). This is also continued in FIG. 5 with additional tabs (603) of information (601).

Figure 5:
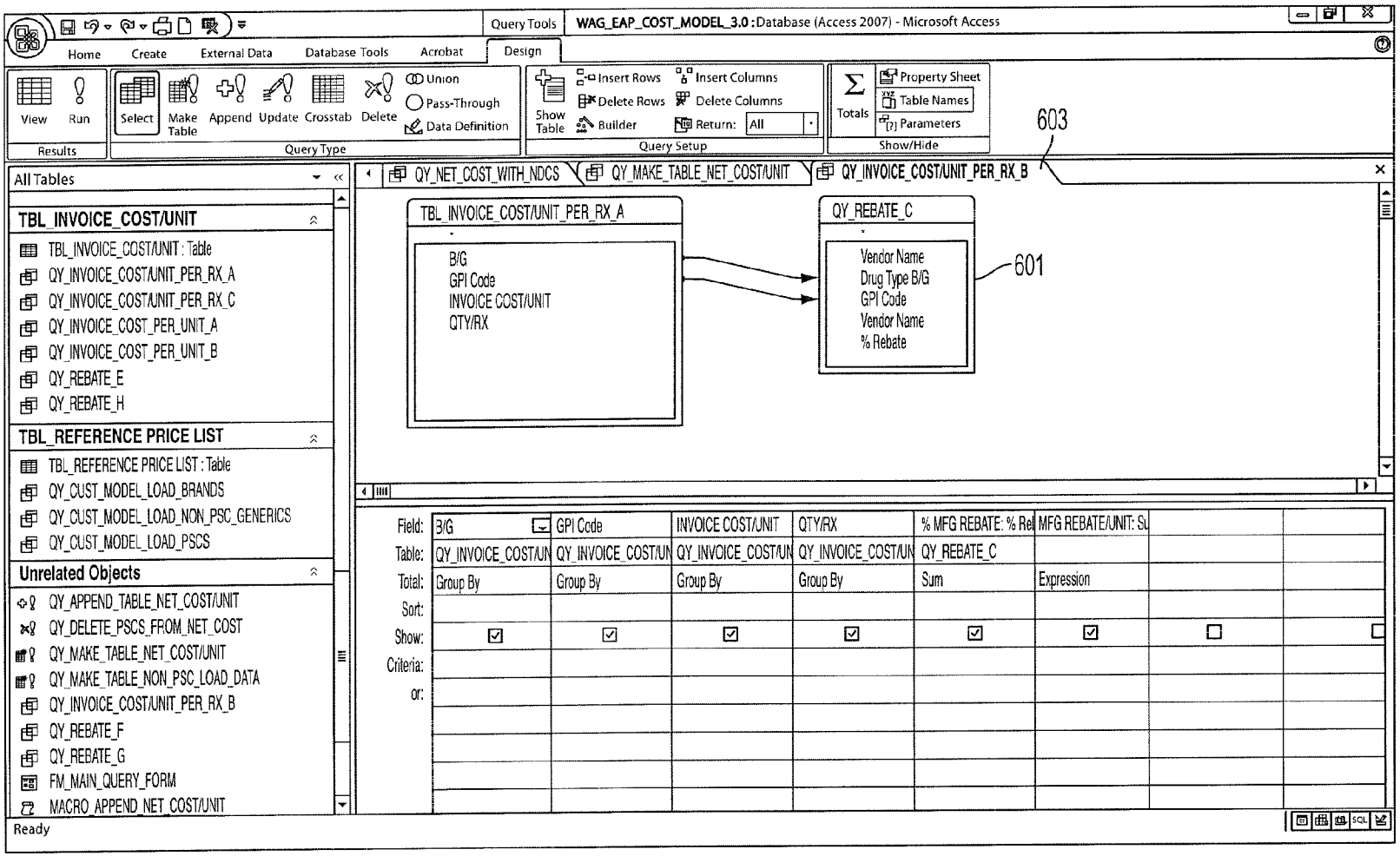
FIG. 5 Provides a screenshot of a place for entering additional information to calculate a net price/unit at the pharmacy.
Figure 6:
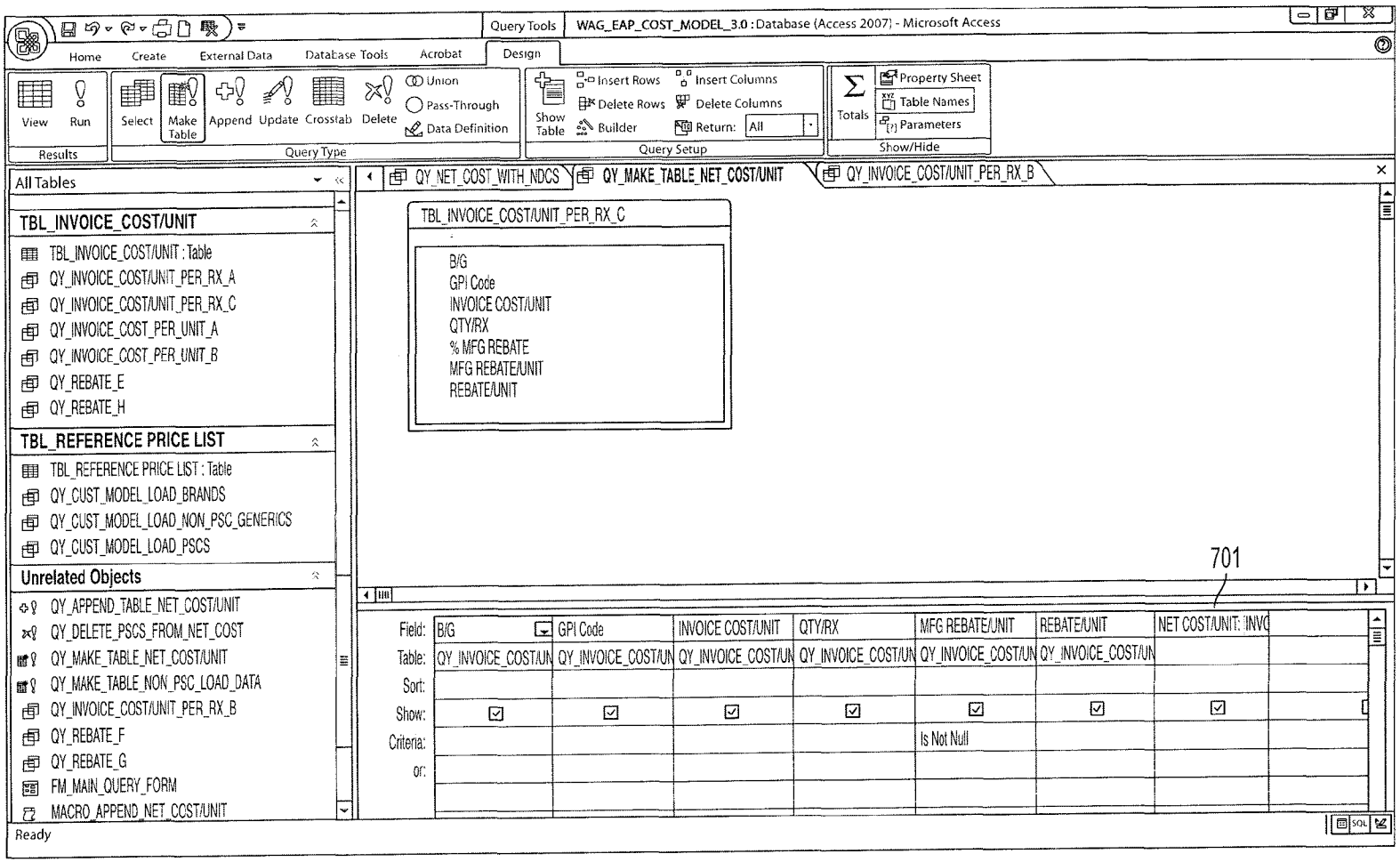
FIG. 6 provides a screenshot indicating the cost/unit calculation outcome.

Once all the information is provided in FIG. 5, a net cost/unit can be calculated pursuant to the pharmacy's operations corresponding to step (103). This is calculated in FIG. 6 and displayed in column (701). This cost, thus, has identified the specific drug being examined as well as all specific cost information associated therewith.

Figure 7:
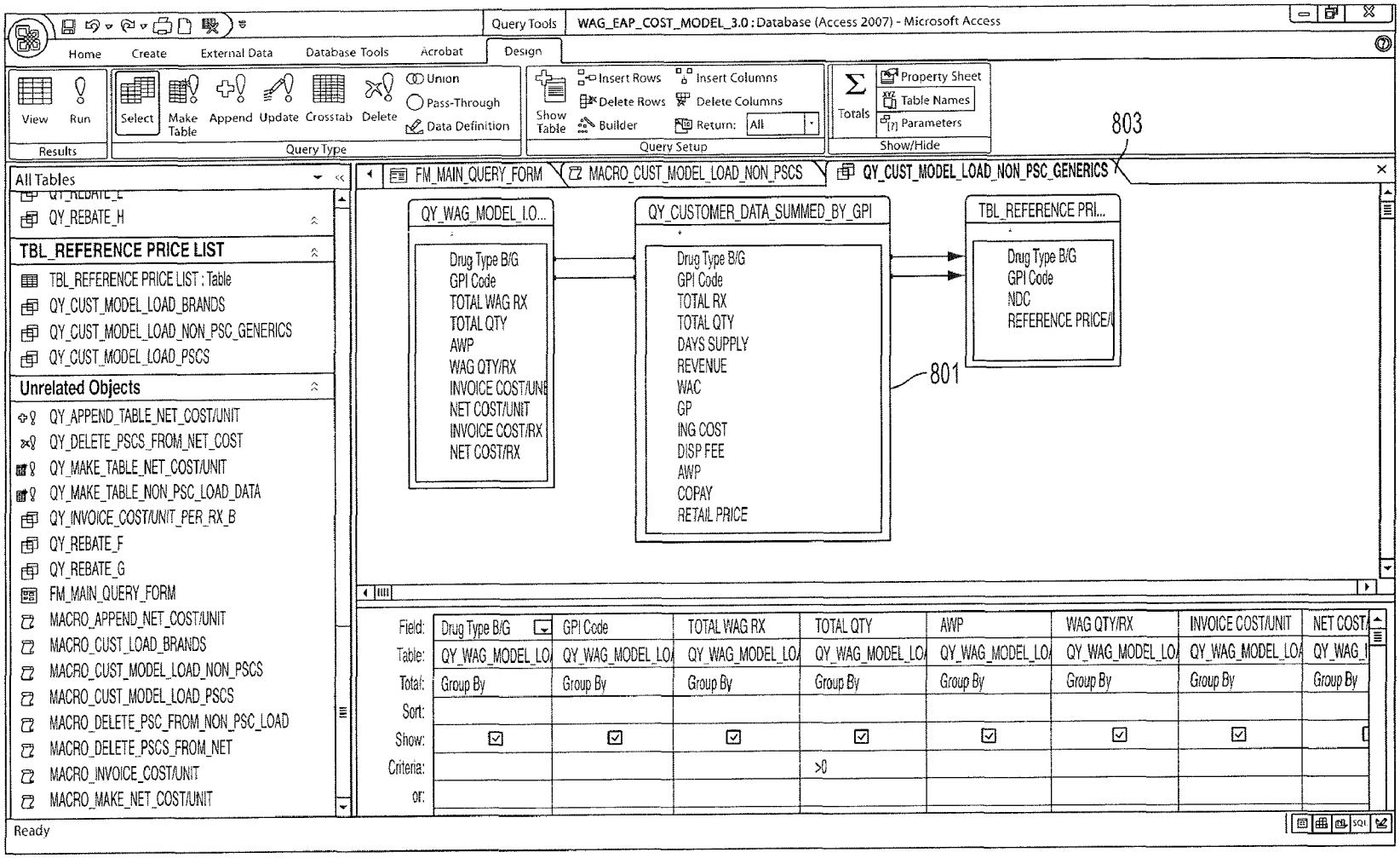
FIG. 7 provides a screenshot of an export tool for moving generic drug information from software for calculating the initial cost/unit into a different piece of software for calculating the "plus" portion of the cost.
Figure 8:
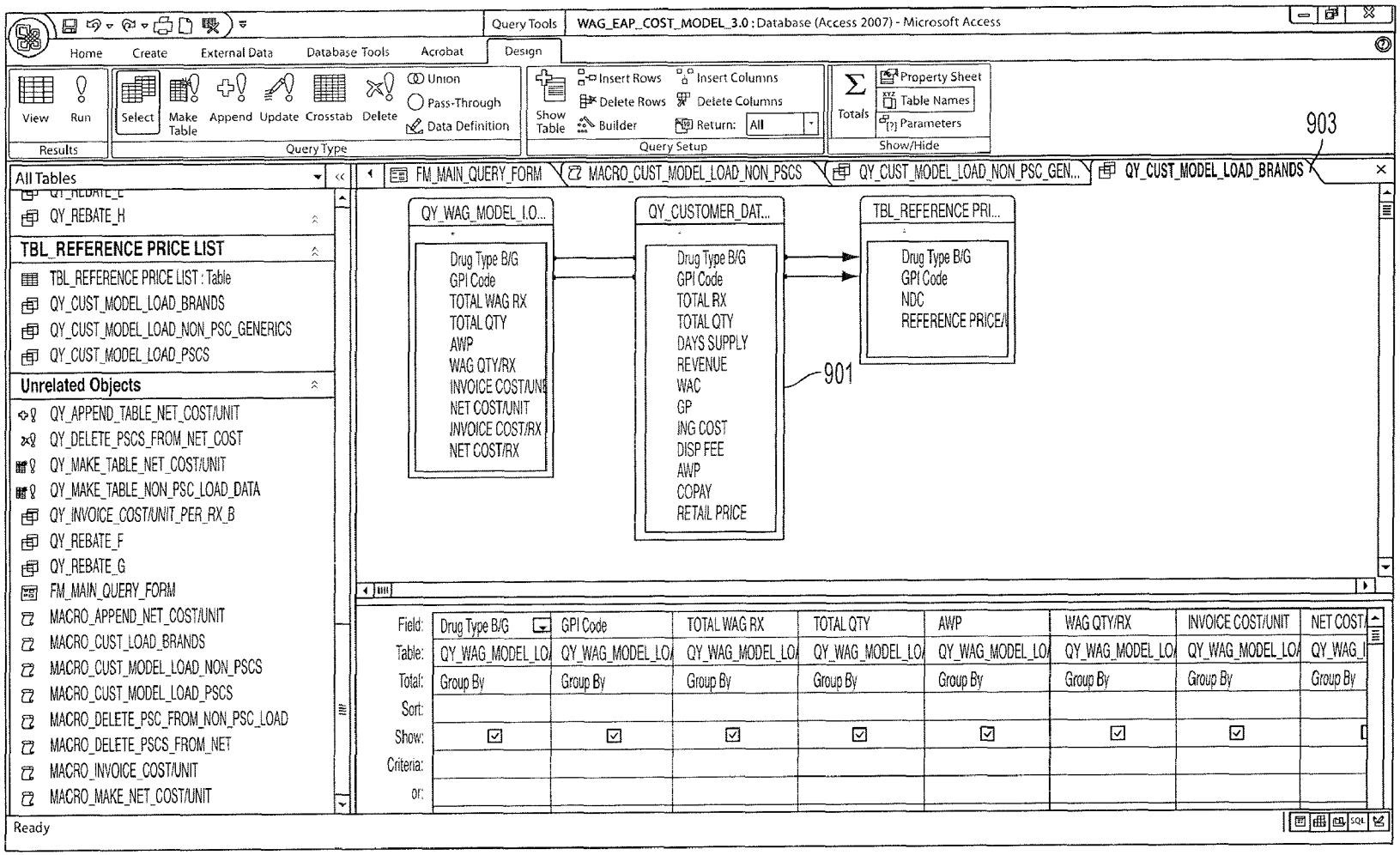
FIG. 8 provides a screenshot of an export tool for moving branded drug information from software for calculating the initial cost/unit into a different piece of software for calculating the "plus" portion of the cost.

FIGS. 7 and 8 create tables of generic (801) and brand name (901) drugs respectively and therefore provide for the total lists of drugs in used in the pharmacy. Again, access to this function and information is provided in a tabbed section (803) or (903). In the depicted embodiment, these tables are created to allow for export of information from the computer software system used to determine per unit initial costs, to a separate software system which will perform the "plus" portion of the pricing.

Figure 9:
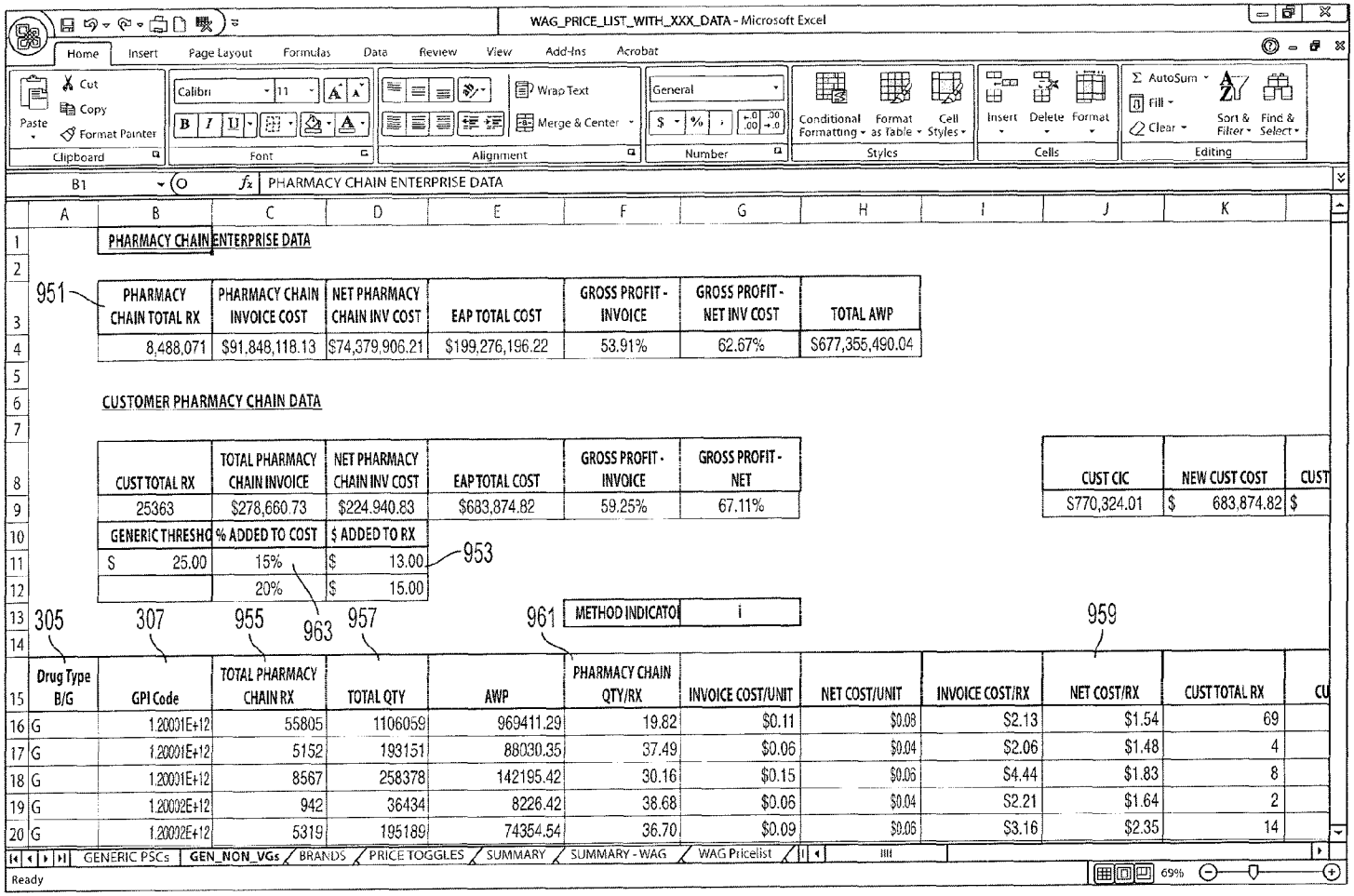
FIG. 9 provides for the left hand side of a screenshot of the performance of a marked-up cost/unit. The drugs shown in FIG. 9 are all generics.
Figure 10:
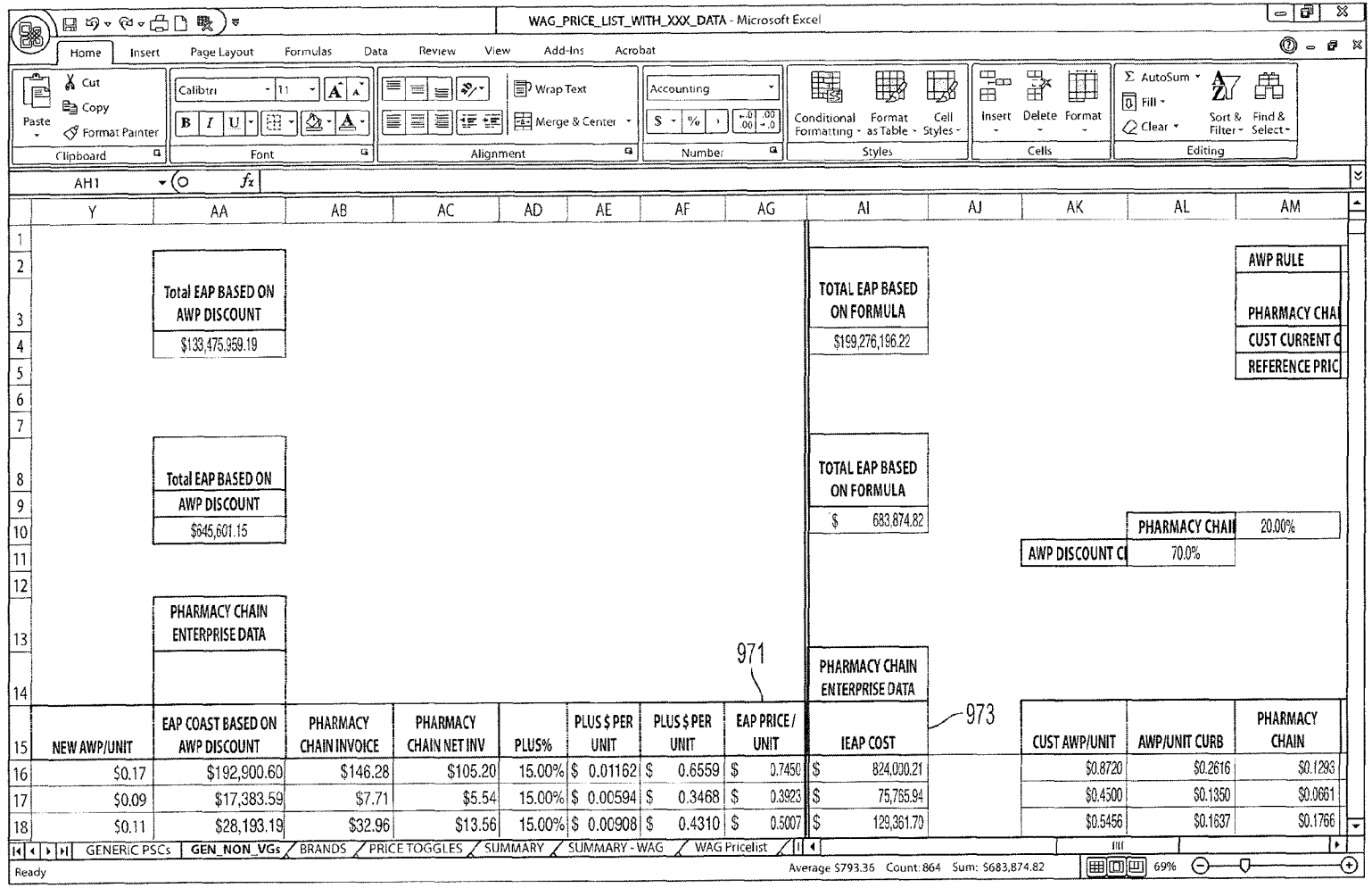
FIG. 10 provides for the right hand side of a screenshot of the performance of a marked-up cost/unit.
Figure 11:
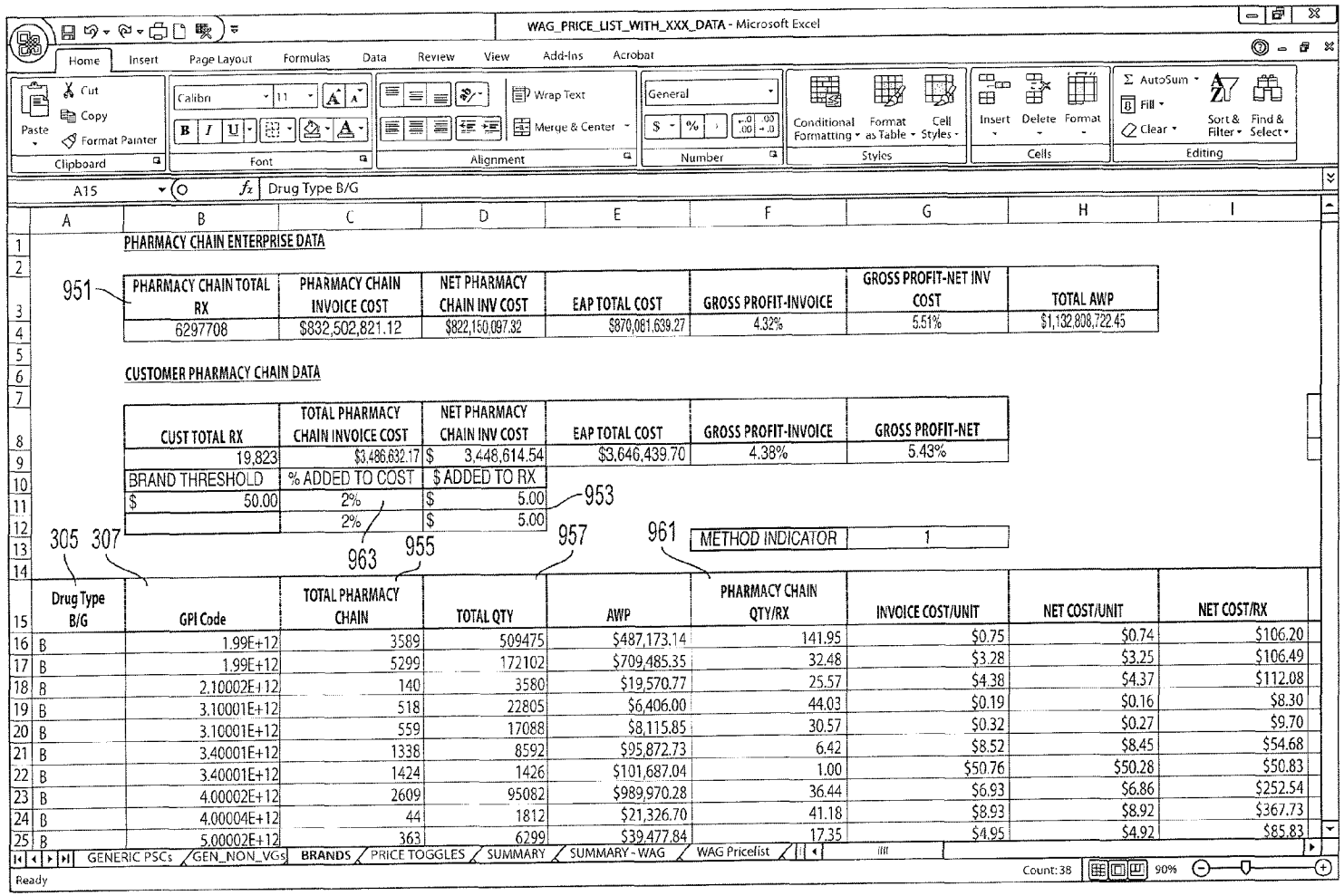
FIG. 11 provides for the screenshot of FIG. 9 except that the drugs are all branded drugs.

FIGS. 9 and 10 (FIG. 10 is a continuation of the right side of FIG. 9) provides for a table indicating the plus calculation for a number of drugs by this second computer system. As can be seen the drug type (305) column and GPI code column (307) have been filled out with some example drug information in these figures. Total pharmacy information may be displayed (951) to provide for general overview information and specific factors (953) (which corresponds to the fixed cost addition (155)) and the percentage (963) (which corresponds to the multiplication factor (153) may be displayed. In FIGS. 9 and 10 all the drugs are generic and tiers are used both for the multiplication factors and the fixed additions. In FIG. 11 a similar display of modifiers (953) and (963) is shown for branded medications (as indicated by the values of column (305)). The amounts used for the branded medications are different, and also do not show the tiering used for generics. No FIG. corresponding to the portion of the display shown in FIG. 10 is provided for the branded medications as it is generally similar to FIG. 10.

FIGS. 9 and 10 also show that the total number of prescriptions filled (957) can be divided by the total number of medication units used (961) to produce an average quantity per prescription (959). FIG. 10 also shows the cost per unit (971) (corresponding to step (157)) and total cost (973) (corresponding to step (159)) calculations from the later steps of calculation.

Figure 12:
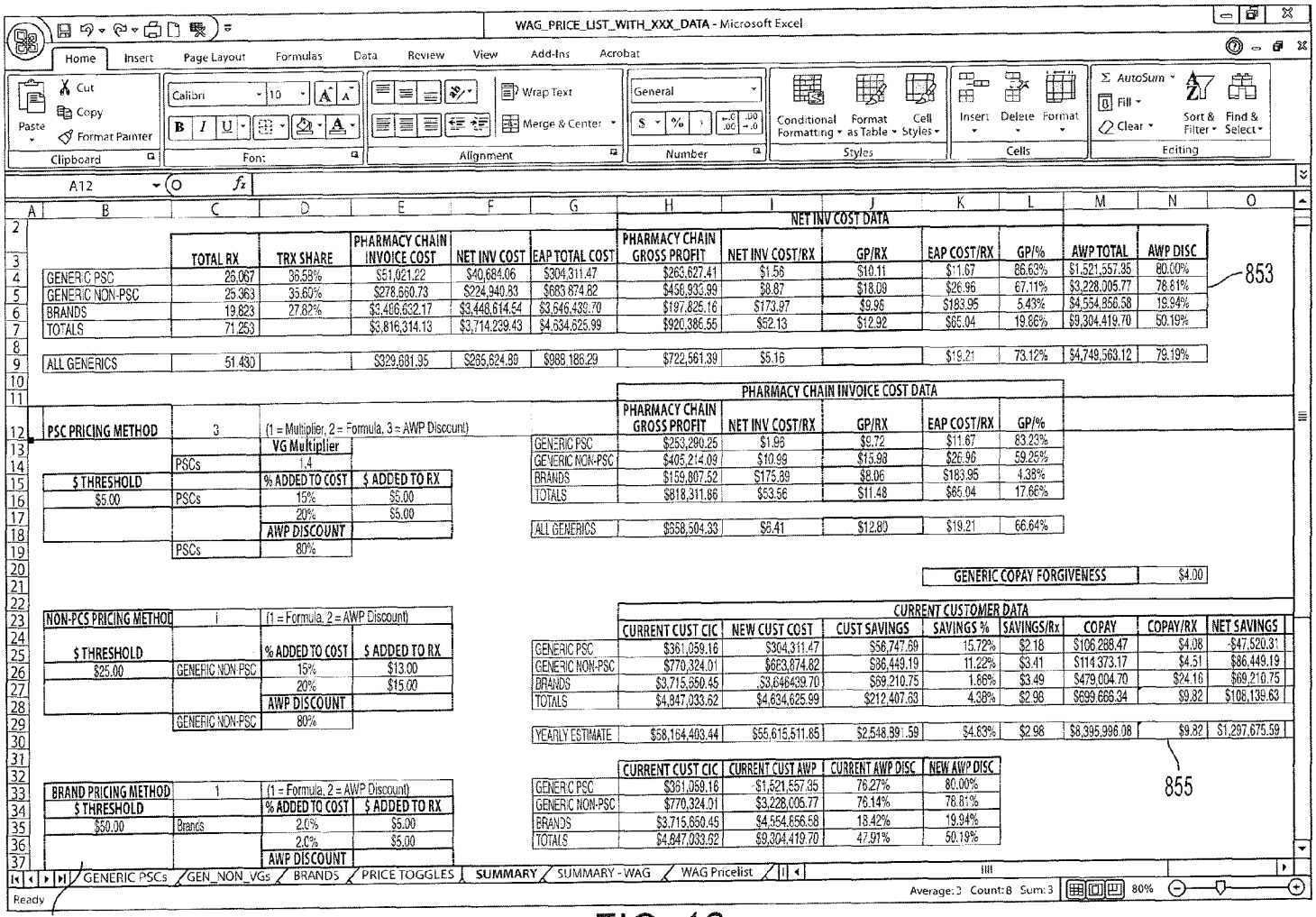
FIG. 12 provides a screenshot showing locations where multipliers and other factors can be altered and for evaluating total profits and patient cost savings.

FIG. 12 provides for the ability to modify the various multipliers and factors which would be used. The table on the tiers (851) corresponds to the calculation factor (953). There are also provided sections to determine pharmacy profits (in total) (853) as well as customer savings (855) when compared against the customer's current costs (855).

While the systems and methods have been discussed herein in conjunction with the sale of prescription medications, the cost-plus pricing model can be used for a variety of purposes, the principle one of which is to utilize the method, in conjunction with predetermined profit objectives, to provide for a method of providing materials, particularly prescription drugs, at a price which maximizes, or at least improves upon, resultant profit while at the same time providing transparency in pharmaceutical pricing. However, the process can be used for any material sold utilizing a similar distribution methodology to prescription medications.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A computer-implemented method of determining cost-plus pricing on a computer, the method comprising:

a computer determining a net cost per unit of a prescription medication paid by a pharmacy;

said computer determining an average number of units in each prior prescription for said prescription medication sold by the pharmacy;

said computer calculating a baseline cost per prescription from said net cost per unit and said average number of units in each prior prescription;

said computer modifying said baseline cost per prescription to provide for a marked up price per prescription;

said computer utilizing said marked up price per prescription and said average number of units in each prior prescription to determine a marked up cost per unit; and said computer calculating a final cost of a prescription to be filled by said pharmacy from a number of units in said prescription to be filled and said marked up cost per unit.

2. The method of claim 1 wherein said step of modifying comprises multiplying said cost per prescription by a predetermined weighting factor.

3. The method of claim 2 wherein said predetermined weighting factor is different for a generic medication than a branded medication.

4. The method of claim 3 wherein said predetermined weighting factor is greater for a generic medication than a branded medication.

5. The method of claim 2 wherein said step of modifying further includes adding a fixed dollar value to the cost per prescription.

6. The method of claim 5 wherein said fixed dollar value is different for a generic medication than a branded medication.

7. The method of claim 6 wherein said fixed dollar value is greater for a generic medication than a branded medication.

8. The method of claim 5 wherein said fixed dollar value includes multiple tiers based on the cost per prescription.

9. The method of claim 8 wherein the tiers are different for branded medications and generic medications.

10. The method of claim 5 wherein said modifying further includes multiplying the cost per prescription by a final markup after adding said fixed dollar value.

11. The method of claim 10 wherein said final markup is different for a generic medication than a branded medication.

12. The method of claim 10 wherein said final markup is greater for a generic medication than a branded medication.

13. A non-transitory computer readable medium comprising:

computer readable instructions for determining a net cost per unit of a prescription medication;

computer readable instructions for determining an the average number of units in each prior prescription for said prescription medication;

computer readable instructions for calculating a baseline cost per prescription from said net cost per unit and said average number of units in each prior prescription;

computer readable instructions for modifying said baseline cost per prescription to provide for a marked up price per prescription; and computer readable instructions for utilizing said marked up price per prescription and said average number of units in each prior prescription to determine a marked up cost per unit.

* * * * *